United States Patent [19]

Yates

[11] 3,986,844

[45] Oct. 19, 1976

[54] ORGANIC SILICON REMOVAL FROM STRIPPER OVERHEAD

[75] Inventor: James E. Yates, Ponca City, Okla.

[73] Assignee: Continental Oil Company, Ponca City, Okla.

[22] Filed: July 23, 1975

[21] Appl. No.: 598,521

[52] U.S. Cl. ..... 44/50; 260/632 D; 260/643 R; 44/70

[51] Int. Cl.[2] ..... C10L 1/04

[58] Field of Search ..... 260/632 D; 44/70, 50

[56] References Cited

UNITED STATES PATENTS

| | | | |
|---|---|---|---|
| 2,892,858 | 6/1959 | Ziegler | 260/632 D |
| 3,097,226 | 7/1963 | Napier | 260/632 D |
| 3,104,251 | 9/1963 | Foster et al. | 260/632 D |

*Primary Examiner*—Robert V. Hines
*Assistant Examiner*—Y. Harris-Smith
*Attorney, Agent, or Firm*—Cortlan R. Schupbach, Jr.

[57] ABSTRACT

Volatile organic silicon compounds from stripper overheads resulting from Ziegler aluminum alkyl synthesis of primary alcohols are hydrogenated to remove undesirable silicon prior to use as a fuel.

4 Claims, No Drawings

ORGANIC SILICON REMOVAL FROM STRIPPER OVERHEAD

This invention relates to a method for using stripper overhead streams as fuel. More particularly, this invention relates to a method for removing undesirable elements from the stripper overhead before use as a fuel.

The use of Ziegler alkyl chemistry in the process of producing synthetic straight chain even carbon numbered alcohols is well known in the art. The process basically proceeds by reacting 2 mols of triethyl aluminum with aluminum and hydrogen to produce three mols of diethyl aluminum hydride. The diethyl aluminum hydride is then reacted with ethylene to produce three mols of aluminum triethyl. The aluminum triethyl is a reactant, 1 mol of which reacts in the process, and 2 mols of which are recycled to produce yet more triethyl aluminum.

The reactant mol of triethyl aluminum is reacted with ethylene to form a long chain aluminum alkyl containing an even number of carbon atoms. This long chain aluminum alkyl is oxidized to form an aluminum alkoxide, thus placing an oxygen atom between the aluminum and the first carbon of the chain. At this point, the volatile by-products and solvent are removed in a stripper overhead stream. The remaining long chain aluminum alkoxide is subsequently hydrolized by methods well known in the art to produce the alcohol and useful by-products.

The stripper overhead removed after the oxidation step of the synthetic primary alcohol process has been utilized in the past as a cracking feed stock and as a fuel for boilers and the like.

The use of the stripper overhead as a boiler fuel is disadvantageous. Used as a boiler fuel results in a build-up of $SiO_2$ (sand) on the external surface of boiler tubes after only a short period of operation. An analysis of the stripper overhead stream usually shows at least 50 parts per million silicon present.

It is desirable that the stripper overhead stream contain no silicon in order that it may be used more effectively as a boiler fuel.

It is therefore an object of the present invention to provide a method whereby the volatile organic silicon compounds can be substantially removed from the overhead streams enabling their use as a fuel. Other objects will become apparent to those skilled in this art as the description proceeds.

It has now been discovered in accordance with the present invention that the silicon from volatile organic silicon-containing compounds can be removed by hydrogenating over catalysts such as Ni on kieselguhr, Ni on alumina, or copper chromite under conditions ranging from about 150° to 300° C and at least 600 pounds per square inch gauge hydrogen pressure.

While the reason for the presence of silicon in the stripper overhead stream is not definitely known, it is believed that the contamination comes from the use of aluminum metal in the above-described process. Most aluminum metal contains silicon in amounts ranging from about 5 to 700 parts per million. During the formation of the aluminum triethyl it is believed that compounds such as silicon tetraethyl are also formed and proceed through the Ziegler synthesis along with the aluminum triethyl. During the oxidation step, it is believed that while the aluminum triethyl compounds are oxidized, the silicon tetraethyl compounds are not oxidized, and are removed from the aluminum alkoxide in the stripper overhead stream.

These volatile organic silicon compounds can be removed by hydrogenation. Representative examples of hydrogenation catalysts which can be used in the process of the present invention are Ni on alumina, Ni on kieselguhr, or copper chromite. Of these, the nickel catalysts are preferred. Other hydrogenation catalysts will also be effective such as platinums and palladiums.

The reaction is normally carried out at a temperature ranging from about 150° to about 300° C. Preferred temperatures range from about 200° to about 250° C.

Normally, the process is carried out at least 600 pounds per square inch gauge (psig) hydrogen pressure. However, more severe conditions of at least about 900 psig are preferred.

The reaction can be carried out either batch-wise or in a fixed bed continuous flow reactor. When carried out in a continuous flow reactor, a minimum weight hourly space velocity (WHSV) of about 0.5 grams of feed/grams catalyst/per hour should be used.

The invention is more concretely described with reference to the working examples below wherein all parts and percentages are by weight unless otherwise specified. The examples are shown for the purpose of illustration only and are not intended to limit the present invention.

EXAMPLE 1

The hydrogenation reaction of the present invention was carried out in a fixed-bed continuous flow reactor. Liquid feed and hydrogen gas were mixed and preheated to the desired operating temperature prior to entering the reactor. The reactor effluent ws discharged into a gas liquid separator where the liquid product was collected and excess hydrogen vented. Various temperatures and catalysts were evaluated. The results are shown in Table I.

TABLE I

| Catalyst | Feed | 60% Ni/ Kieselguhr | Ba Promoted $CuCrO_4$ | 60% Ni on Alumina | 60% Ni on Alumina |
|---|---|---|---|---|---|
| Temperature (°C) | — | 225 | 250 | 225 | 225 |
| Pressure (psig) | — | 800 | 800 | 800 | 800 |
| WHSV (g feed/g cat./hr) | — | 1.0 | 1.0 | 1.0 | 1.0 |
| Si (ppm) | 79 | 10 | 22 | 3 | 5 |

Test 1 was carried out using only the feed stock common to the other tests. It will be noted that the silicon content was 79 parts per million. After utilizing the process of the present invention, the silicon content ranged from 3 to 22 parts per million depending upon the catalyst used. Catalysts used were Test No. 2 – Ni-0104T sold by Harshaw Chemical Company; Test No. 3 – Girdler G-22; Test No. 4 – 201-T sold by Calsicat Division, Mallinckiodt, Inc.; Test No. 5 – 203-T sold by Calsicat Division, Mallinckiodt, Inc.

Final disposition of the removed silicon is not definitely known. It is believed that the silicon unites with hydrogen after cleavage from the alkyl groups and is vented along with excess hydrogen. Some silicon can be tolerated on the catalysts used without affecting their utility.

It can be clearly seen that utilization of the process of the present invention will allow the stripper overheads resulting from the synthetic primary alcohol process utilizing the Ziegler aluminum alkyl chemistry to be used as a boiler fuel or as a cracking stock while substantially reducing contamination from organic silicon compounds.

While certain embodiments and details have been shown for the purpose of illustrating this invention, it will be apparent to those skilled in this art that various changes and modifications may be made herein without departing from the spirit of the scope of the invention.

I claim:

1. A method for the production of a fuel comprising the removal of volatile organic silicon compounds from stripper overhead streams resulting from the synthetic primary alcohol production using Ziegler aluminum alkyl processes, hydrogenating the silicon-containing compounds herein over hydrogenation catalysts and using the resultant material as a fuel.

2. A method as described in claim 1 wherein the catalyst is selected from the group consisting of Ni on kiesclguhr, Ni on alumina, or copper chromite.

3. A method as described in claim 2 wherein the hydrogenation is carried out at a temperature of from about 150° to about 300° C.

4. A method as described in claim 2 wherein the hydrogenation is carried out under at least 600 pounds per square inch gauge hydrogen pressure.

* * * * *